US007530567B2

(12) United States Patent
Bober et al.

(10) Patent No.: US 7,530,567 B2
(45) Date of Patent: May 12, 2009

(54) FINISHER COMPILER TRAY

(75) Inventors: Henry T. Bober, Fairport, NY (US); Chetan S. Keny, Webster, NY (US); Peter J. Knausdorf, Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 235 days.

(21) Appl. No.: 11/715,530

(22) Filed: Mar. 8, 2007

(65) Prior Publication Data

US 2008/0217844 A1 Sep. 11, 2008

(51) Int. Cl.
*B65H 31/26* (2006.01)

(52) U.S. Cl. ..... 271/220; 271/207

(58) Field of Classification Search ..... 271/220, 271/224, 207; 270/58.01; 399/406
See application file for complete search history.

(56) References Cited

U.S. PATENT DOCUMENTS 6,330,999 B2 * 12/2001 Coombs et al. ..... 270/58.18
6,450,492 B1 * 9/2002 Coombs et al. ..... 270/58.08
6,547,229 B1 * 4/2003 Hanson et al. ..... 270/52.09
6,641,346 B2 * 11/2003 Bagrosky ..... 412/38
6,736,388 B2 * 5/2004 Lawrence ..... 270/58.08
7,007,946 B1 * 3/2006 Dobrindt et al. ..... 271/189
2006/0244197 A1 * 11/2006 Yee et al. ..... 271/145

* cited by examiner

*Primary Examiner*—Patrick H Mackey
*Assistant Examiner*—Jeremy Severson
(74) *Attorney, Agent, or Firm*—James J. Ralabate

(57) ABSTRACT

This is a compiler tray with a Velcro® surfaced back guide enabled to be used with Birds Beak Edge Curl Suppressors to minimize up curl and down curl of sheets fed into the tray and improve Stapled Set Registration. The Velcro® is either fixed to the back guide or adjustably positioned on the back guide. The Velcro® is placed on the back guide in such a manner that the ribs and grooves of the Velcro® are at an angle significantly not parallel to the plane of the lead edge of paper sheets fed into the compiling tray.

16 Claims, 7 Drawing Sheets

FINISHER COMPILER TRAY

BACKGROUND

There are many marking systems that transport paper or other media after the paper is marked in a marking step or steps. Some such marking systems include electrostatic marking systems, non-electrostatic marking systems and printers or any other system where paper or other flexible media or receiving sheets are transported internally to an output device, such as a finisher and compiler station or stations. These devices include those used for collecting or gathering printed sheets so that they may be formed into books, pamphlets, forms, sales literature, instruction books and manuals and the like.

These marking systems, as above noted, have finisher and compilers located at a site after the receiving sheets (paper) have been marked. A finisher is generally defined as an output device that has various post printer functions or options such as hole punching, corner stapling, edge stapling, sheet and set stacking, letter or tri-folding, Z-Folding, Bi-folding, signature booklet making, set binding [including thermal, tape and perfect binding], trimming, post process sheet insertion, saddle stitching, and others. The function of the Compiler is to produce accurately registered or edge aligned sets of sheets prior to subsequent Finishing operations.

The compiler often employs a compiling wall or tray where gravity and/or frictional drive elements are used to drive sheets (paper) against the registration or compiling wall for registration of the staple or bind edge of a paper set. If desirable, frictional drive elements such as belts, scuffer wheels, or paddle wheels, etc. may be used. Sheet counting is frequently used as a criterion to index the Compiler Drive element shaft as the compiled stack height increases, but it does not successfully comprehend curl build up or variations in the paper media thickness.

The compiling capacity and bind edge sheet registration of the paper can be compromised with moderate to severe curl on the sheets. The curl can be concave up or concave down and curl build-up generally progressively increases as the paper stack height grows. Excessive curling can cause poor set registration and possibly paper jams or sheet damage. It is observed that curling is more significant with higher stack heights (above—50 to 70 sheet sets with 20# letter LEF), the bind edge height builds up faster than the set thickness, the curl build up is progressive, increasing more rapidly as Stack Height grows. When clamped by the Staple Head, the set shingles and Stapled Set Registration is disturbed as the Bind Edge Curl is suppressed. Increased load on the Bind Edge Curl Suppressors would solve the problem; however, it would also require a dramatic increase in sheet Drive Force to overcome the frictional drag effects of this increased suppression force, eventually leading to the buckling of light weight media in the compiler tray. When the incoming paper is not in proper registration because of curl, as noted, this causes poor set registration prior to stapling and other finishing steps.

SUMMARY

It has been found that applying a texture to the surface of the back guide (or registration or compiling wall) when combined with at least one set of appropriate Bind Edge Curl Suppressors such as the Bird's Beak Curl Suppressor(s) prevents the incoming curled bind edge of the sheets from sliding up or down the back guide with up curled or down curled media. A functionally flat surface is required in a finisher compiler tray where the sheet is driven forcibly against said Registration surface (or back guide) at a fairly high frequency. It has been found that Velcro (Registered Trademark of Velcro Industries, BV) is a textured material that we have tested to minimize curling of the paper, when the Velcro® is used on the surface of the compiler tray back guide. Generally, Velcro® has a series of Plastic Hooks closely spaced and aligned to form a series of parallel ribs or grooves running along the surface of the "Hook" Fabric. In several experiments and tests, it was found that the Velcro® should be oriented at an angle on the back guide that is significantly not parallel to the plane of the lead edge of the paper that is forced against the Velcro® surface. Angles of 30-60 degrees from the parallel of the plane of this lead edge have been found to be effective in reducing curl, while angles of 40-50 degrees have been found to be significantly more effective because of possible waviness in the edge of the sheets. The Velcro® will provide a wear resistant and non-abrasive material that: when applied to the compiler tray bind edge registration surface and when preferably oriented with the grooves at 40-50 degrees from the plane of the paper. The Velcro® covered back guide will snub the curled bind edge of the incoming sheet and prevent up curl from sliding up the back guide as it is driven into final registration by the compiler mechanism, and similarly prevent down curl from sliding down between the stack and the back guide, both of these events cause poor set registration prior to stapling. Velcro® is a two part fastening system available in sheet form made up of a side of hooks and an opposite side of pile. However, the hook material only is used in this novel invention and pile material is not needed in the present system. The back of the Velcro® sheet is typically coated with double backed adhesive (tape). Rectangular pieces of the Velcro are cut, die cut, or laser cut, etc. to fit onto the registration surface of the back guide. The assembly is completed by removing the release paper to expose the adhesive and then aligning, locating and pressing the strip into position on the back guide so that the grooves in the hook fabric are oriented at a 30-60 degree incline to the nominal plane of the approaching Bind Edge of the sheet in the compiler tray. A primary advantage of this invention is increased curl handling latitude in the any finisher. It extends finisher stapled set compiling performance capabilities from +/−10 mm Curl [as measured on a horizontal surface] to +/−20 mm or greater of curl. Bind Edge Curl Suppressors are well known in the prior art. Bind Edge Curl Suppressors are best suited to avoiding distortion or disturbance of the Registration of the Bind Edge of the set when they act perpendicular to the top of the stack in the compiler station. One such style of Bind Edge Curl Suppressors are the "Birds Beak" Curl Suppressors. When properly designed Curl Suppressors are used in conjunction with the Velcro® surface back guide (or compiling wall) the combination effectively prevents stapled set registration degradation from curl up and curl down of the leading edges of paper entering the compiling tray. Oriented Velcro® covered back guides placed to the inside of the Bird's Beak Curl Suppressors effectively prevent curled media or sheets from sliding up the back guides or from wedging itself down between the back guides and the stack of sheets in the compiling tray.

The addition of Velcro® or a similar suitable textured material or textured surface to the compiler tray bind edge registration guides of the finishing tray improves the curl handling latitude in especially high speed marking systems. This high friction material reduces the effect of stack height build-up at the registration or bind edge due to curl. This curl build up contributes to gross stapled set mis-registration. The hook side of Velcro® was identified as a suitable material that we tested successfully. Curl height build up at the bind edge was reduced significantly, thus improving Stapled Set registration and other compiling functions. The orientation of the Velcro® hooks (or other such suitable patterned surfaces) are critical to maintaining a "flat registration edge surface" with mechanical stubbing features to prevent curled sheets sliding up/down the back guide due to compiler element drive forces. Other suitable materials with properties similar to Velcro® are expected to yield improvement as well, however, the embodiments of the present invention will be described herein using highly preferred Velcro®. It should be understood, however, that any suitable surface on the back guide with similar surface texture/properties to the Velcro® surface may be effectively used. The Velcro® when properly oriented and used with the translating bind edge curl suppressors compared to prior art performance with curl up or curl down is substantially more effective and has broader Curl Handling Latitude and Set Size Capacity than non-Velcro surfaces used in similar circumstances. The reduction of curling and paper flattening effects, using Velcro® as defined herein was at least two (2) times more effective than non-Velcro surfaces. The use of Velcro® as described makes the marking system generally insensitive to curling paper problems within curl levels reasonably experienced in such products. Our testing has shown that the use of Velcro® on the back guide is very effective for suppressing moderate to high curl levels, effective in improving Stapled Set Registration and extremely beneficial in reduction of OoR's (random sheets out of registration). Furthermore, it was determined that Velcro®, oriented with the groove at 40-50 degrees, improves Stapled Set Registration performance by 50% over Velcro® surfaces with a horizontal groove [parallel to the plane of the paper], Stapled Set Registration performance with 140 grit sand paper falls in between the two Velcro® orientations tested (life problems are expected), Stapled Set Registration performance with 80 grit sandpaper experienced excessive variability. It is recommended that for best results translating bind edge curl suppressors be used together with the Velcro® surface in any Finisher compiler tray, Velcro® hooks be applied to the back guide or reg surface, the groove between the rows of Velcro® hooks be oriented at preferably 40-50 degrees but 30-60 degrees can be used.

Our tests also showed that if the Velcro® hooks are oriented horizontally (i.e. parallel to the plane of the leading edge of the paper), some sheets would enter the grooves while some would register along the top of the hooks. This is not effective since it creates an uneven back guide surface for registering the bind edge of the stack. This was not acceptable for compiler registration.

The solution to these curl problems is to orient the Velcro® grooves at preferably a 40-50 degree angle. This grossly misaligns the grooves in the Velcro® fabric from the plane of the edge of the paper. The rows of hooks are tightly spaced and alternately face opposite directions. Therefore, the grooves run in only one direction. Thus, when properly oriented, this provides a functionally flat surface for paper to register against the Velcro® on the bind edge. Birds Beak Bind Edge curl suppressors work better than other curl suppressors when used with the Velcro® surface on the back guide. Together both the oriented Velcro® and the bird's beak (or perpendicular acting bind edge curl suppressors) give optimum results in preventing curl riding up and sliding down the back guide.

DETAILED DISCUSSION OF DRAWINGS AND PREFERRED EMBODIMENTS

Figure 1:
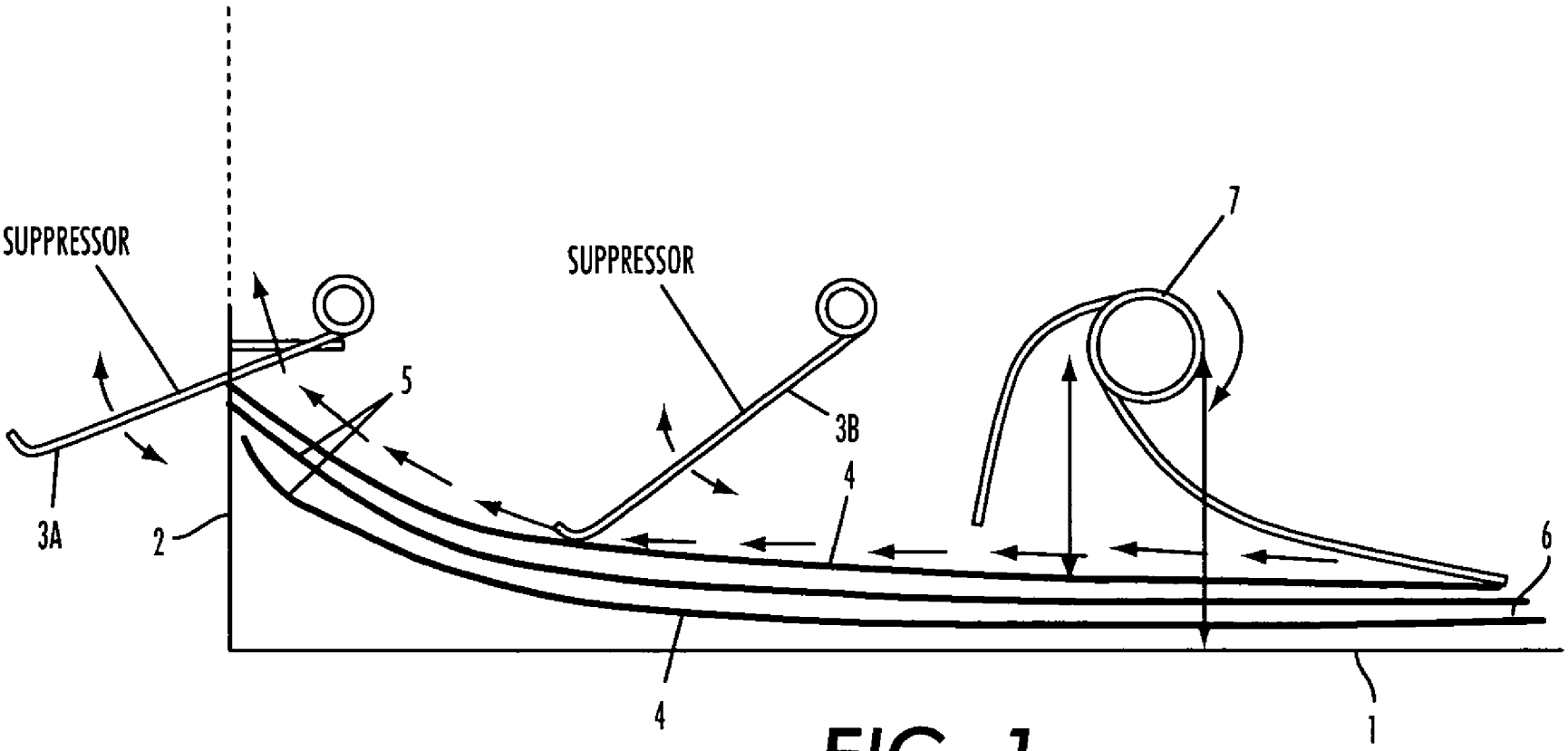
FIG. 1 PRIOR ART
FIG. 1 illustrates a side view of a generally used compiler tray having up curl in the receiving sheets.
Figure 2:
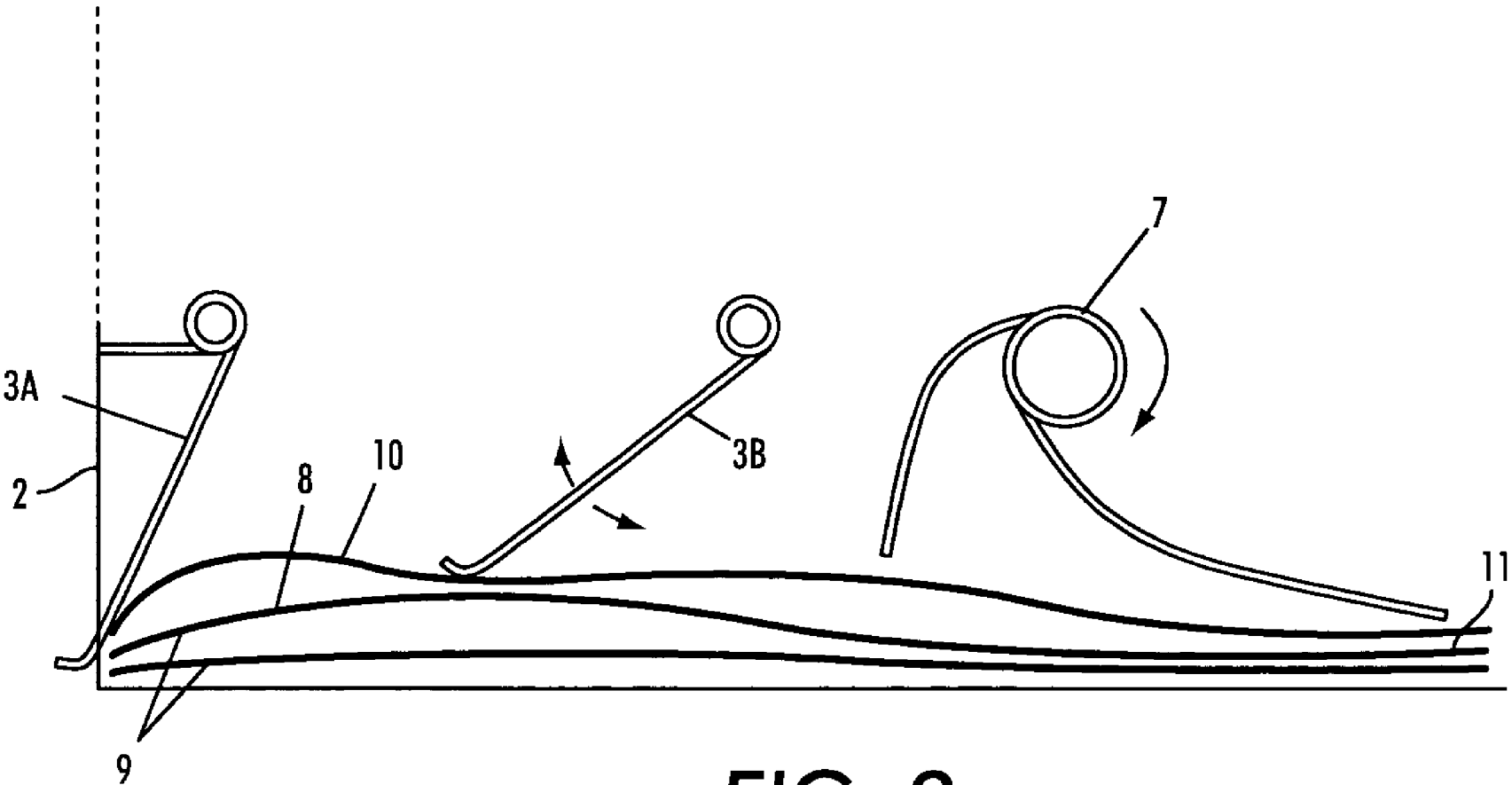
FIG. 2 PRIOR ART
FIG. 2 illustrates a side view of a generally used compiler tray having down curl in the receiving sheets.

In FIG. 1, a side of a compiling tray 1 used in the prior art is shown having a back guide (or compiling wall) 2 and pivotally mounted curl suppressors 3A and 3B. As paper sheets 4 enter the compiling tray 1, even with some curl suppressors 3A and 3B, sheets 4 will often curl up at leading edge 5 so that the sheets 4 become easily misaligned at paper back edge 6. Paddle wheels 7 or other frictional drive elements are used to drive the paper 4 forward into registration against the back guide 2. While in this prior art configuration, curl suppressors 3A and 3B reduce the tendency of the sheets 4 to curl up, by nature of their geometry, they often permit the compiling accuracy to be degraded which provides inadequate stapled set registration and often causes a paper jam or damage to the marking system. As shown, paddle wheels 7 push paper 4 into the tray 1 and against back guide wall 2; the curl up becomes more severe as the paper stack increases. Paper curl down also frequently occurs as shown in FIG. 2. Down curled sheets 8 tend to hump up or buckle excessively near the bind edge or leading edge 9. As the stack height increases, the cusp height also grows. The top sheet 10 is more prone to buckling. The situation degrades as subsequent bind edges 9 can be forced down between the back guide 2 and the curled sheets 8 and mis-registration becomes excessive as shown at the thumb edge end sheet position 11.

Figure 3:
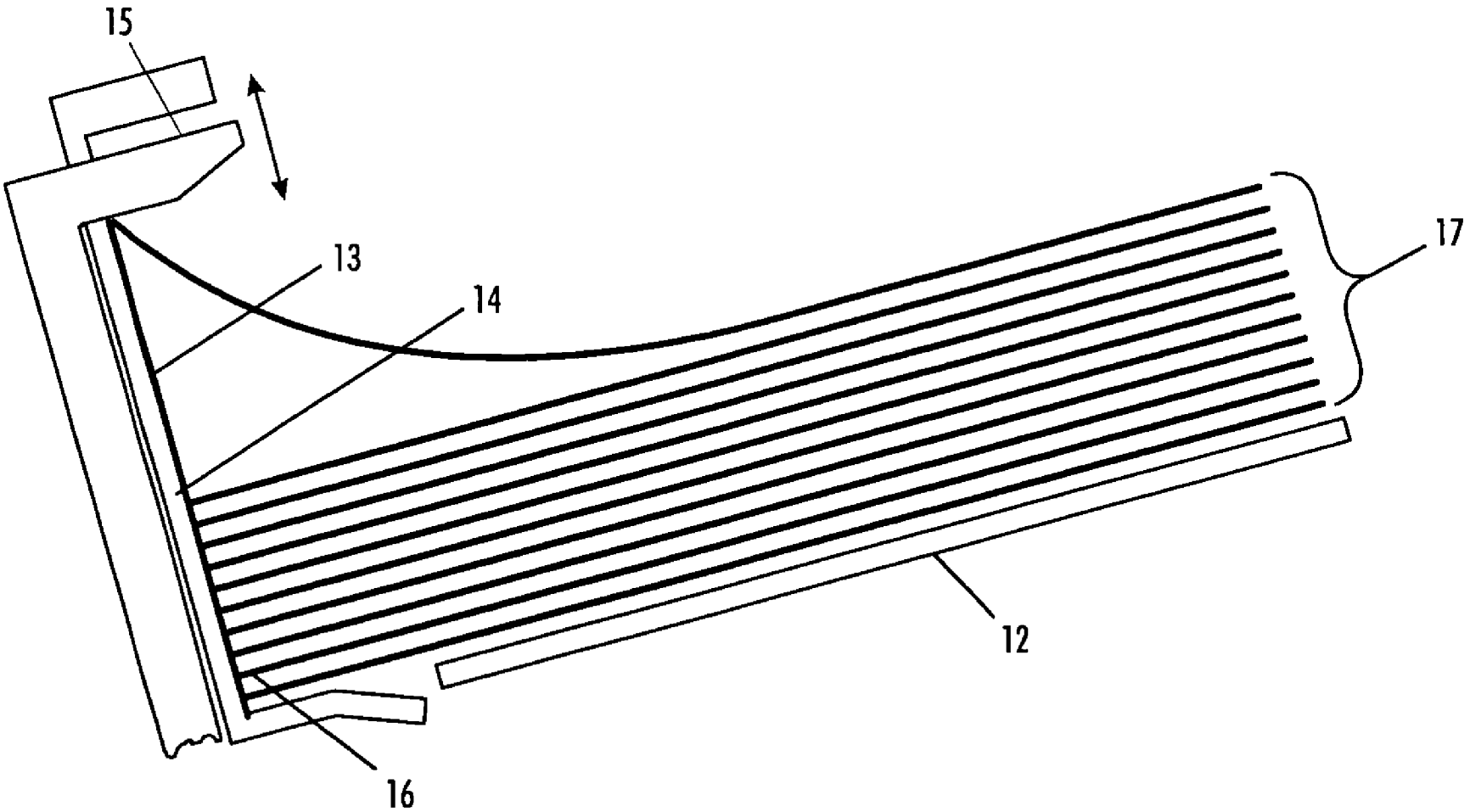
FIG. 3 illustrates a side view of a compiler tray having Bind Edge Curl Suppressors acting perpendicular to the stack and a Velcro® backing on the back guide.

In FIG. 3, a side view of a compiler tray 12 of an embodiment of the present invention is shown with a Velcro® surface 13 on the back guide 2. A set of perpendicular acting or bird's beak bind edge curl suppressor 15 works better with the back guide 14 Velcro® surface 13 than other curl suppressors and is preferred. The Velcro® surface 13 provides beneficial resistance to the sliding of possible up curled bind edge 16 on the back guide 14. The Velcro® surface 13 is also very effective in preventing down curled bind edges 16 from sliding down behind the paper stack 17.

Figure 4:
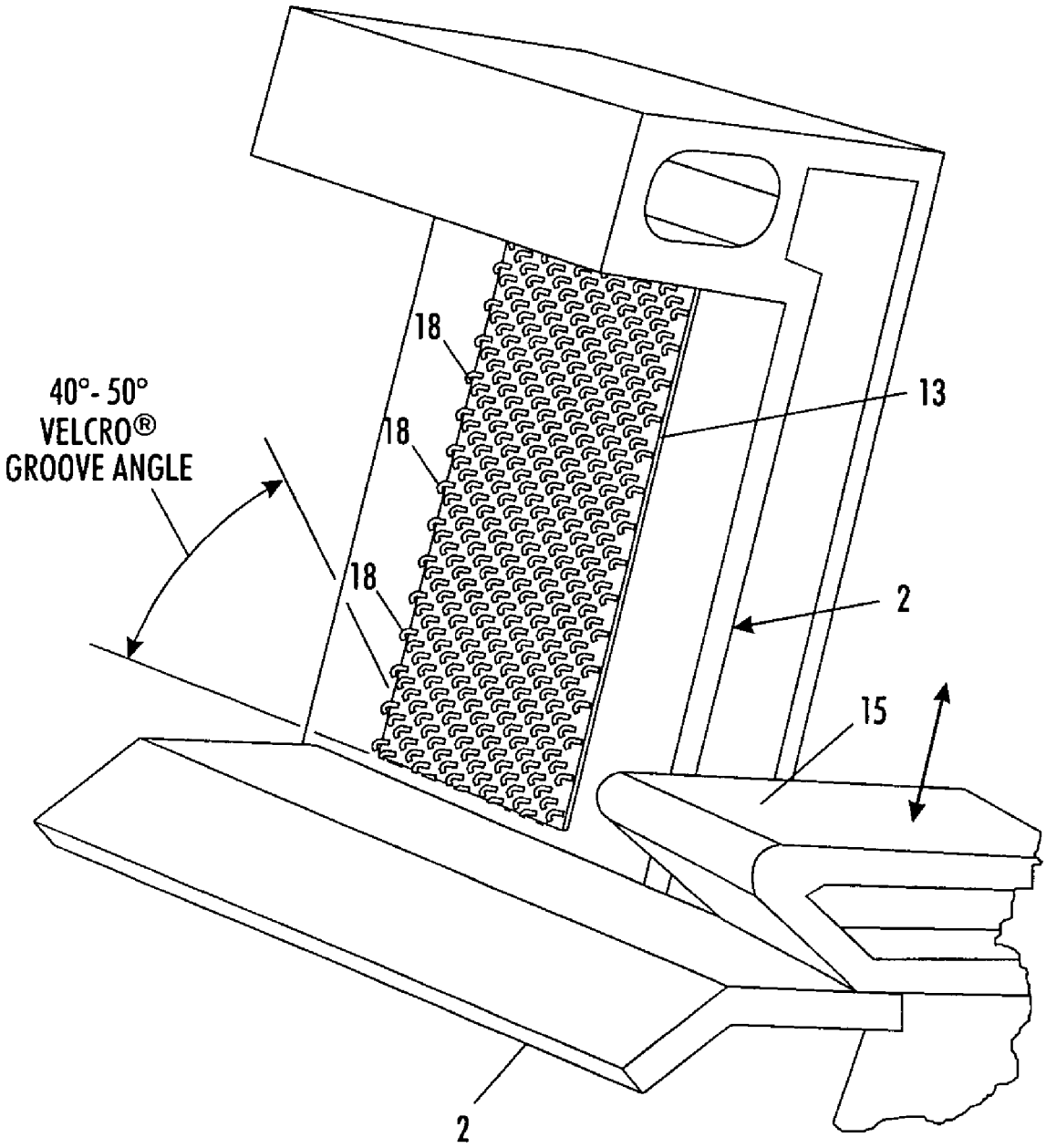
FIG. 4 illustrates a perspective front view of a Velcro® backing on a back guide where the Velcro® is fixed with the grooves oriented at a 45 degree angle.

In FIG. 4, a back guide 2 of an embodiment of this invention is shown with a fixed slanted Velcro® surface 13 with the ribs and grooves 18 slanted at an angle of from about 40-50 degrees from horizontal. The Velcro® 13 covered back guide 2 will snub the curled bind edge 5 of the incoming sheet (see FIG. 1) and prevent up curl or down curl from sliding up or down the back guide 2 as it is driven into final registration. The use of Bird's Beak Suppressors 15 significantly improves the effectiveness of the Velcro® surface 13. As earlier noted, the hook and groove 18 material side of the Velcro® is used in the present invention and the pile material of the Velcro® is not needed for use in the present invention.

Figure 5:
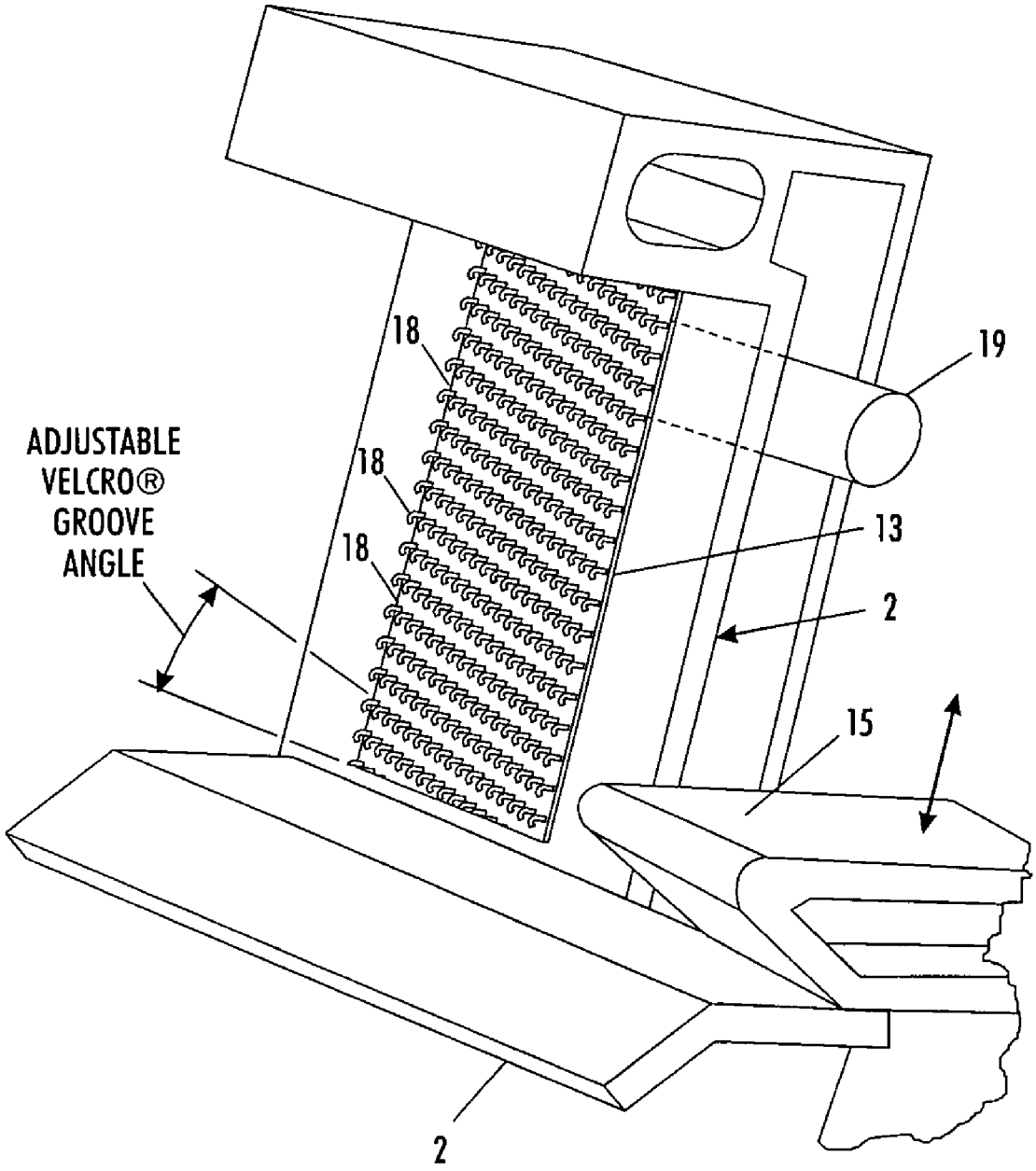
FIG. 5 illustrates a perspective front view of a Velcro® backing where the Velcro surface is adjustable within a 30-60 degree angle.

In FIG. 5, the same configuration as in FIG. 4 is shown except that in FIG. 5 the angle slant of Velcro® surface 13 is adjustable within the angle range of 30-60 degrees from horizontal. A Velcro® adjuster 19 is used in this embodiment to alter or adjust the angle of the Velcro® ribs and grooves between 30-60 degrees. Velco® will be referred to in the claims as a "hook material of hook and loop-type fasteners".

Figure 6:
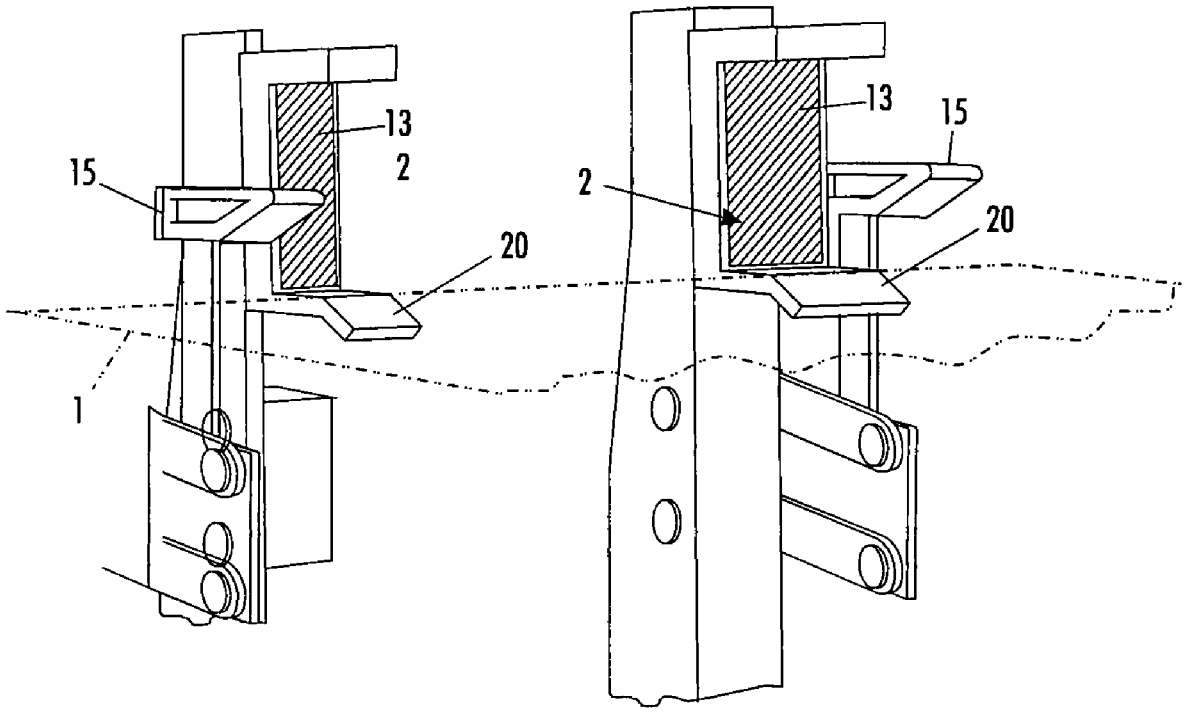
FIG. 6 illustrates a front perspective view of the Velcro® surfaces as used with Bind Edge Curl Suppressors acting perpendicular to the stack.

In FIG. 6, a front perspective view of a pair of back guides 2 and curl suppressors 15 of an embodiment of this invention is illustrated. The bird's beak curl suppressors 15 are shown on either side of the Velcro® surface 13 on the back guides 2. A tray level guide 20 is part of the back guide 2 and is used to direct incoming paper into the compiling tray 1 when the paper is pushed against back guide 2. The compiling tray 1 shown in FIG. 6 illustrates the cooperation between the bird's beak suppressors 15 and the Velcro backings 13 upon which the leading edge of the paper 9 is driven.

Figure 7A:
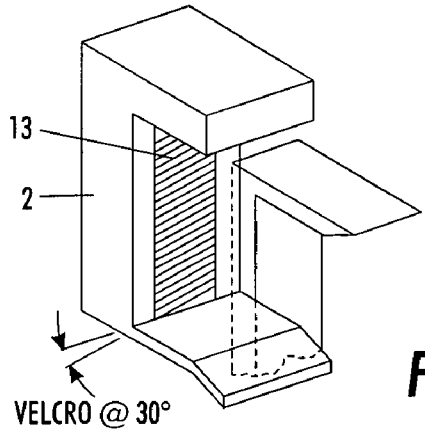
FIGS. 7A, 7B and 7C illustrate Velcro surfaced back guides with varying orientations of the Velcro® ribs and grooves.
Figure 7B:
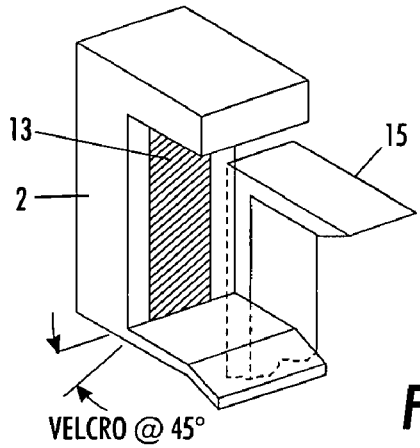
Figure 7C:
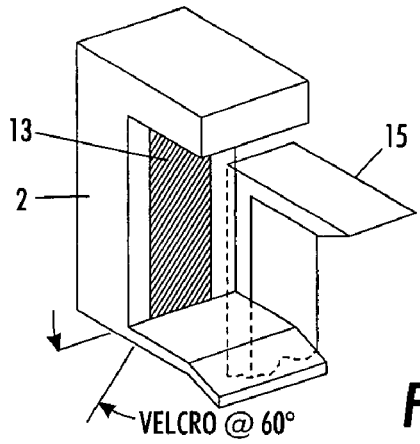

In FIGS. 7A, 7B and 7C, the back guides 2 have Velcro® surfaces 13 of varying degrees of slant. In FIG. 7A the Velcro is set so that the Velcro® surface 13 ribs are at about 30 degrees from horizontal. In FIG. 7B, the Velcro® angle is set at about 45 degrees, and in FIG. 7C set at about 60 degrees. Obviously these angles can be set or adjustable as shown in FIG. 5.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A finisher compiling tray or structure useful in a marking system which comprises:

at least one paper sheets drive element, a compiler tray, and at least one set of bind edge curl suppressors acting perpendicular to the stack, said compiler tray enabled to collect and house a stack of said paper sheets, said compiler tray comprising a configuration with a tray base connected to a back guide or compiling wall, said compiling wall adapted to receive the leading edges of said stack of sheets, said compiling wall comprising a hook material of hook and loop-type fastener(s) surface which is set on said wall having its ribs and grooves at an angle not parallel to a plane of a lead edge of said paper sheets fed into said compiling tray, said bind edge curl suppressors configured to control bind edge quality for both up and down curl of said stack of sheets.

2. The structure of claim 1 wherein said compiling wall has an adjusting element that is configured to alter said angle of said fastener's surface from about 30-60 degrees from parallel to the plane of said paper lead edge.

3. The structure of claim 1 wherein said fastener's surface is fixed on said compiling wall or registration back at an angle of from about 30-60 degrees from parallel to the plane of said lead edge.

4. The structure of claim 1 wherein said fastener's surface is positioned on said registration back at an angle of about 40-50 degrees from parallel to the plane of said lead edge.

5. The structure of claim 1 wherein said fasteners are used in said compiler tray on said compiling wall positioned between two of said curl suppressor(s).

6. The structure of claim 1 wherein said fasteners are positioned on said compiling wall between at least two bind edge curl suppressors and wherein said fasteners are at an angle of 40-50 degrees from horizontal.

7. The structure of claim 1 wherein said fastener's surface is configured to prevent or minimize lead edge curl up in said paper in said compiler tray.

8. The structure of claim 1 wherein said fastener's surface is configured to prevent or minimize lead edge down curl in said paper in said compiler tray.

9. The structure of claim 1 wherein said fasteners surface is configured to improve paper registration prior to further processing of said paper.

10. A finisher compiling station useful in a paper marking system which comprises:

at least one paper sheet drive mechanism, a compiling tray and at least one set of bind edge curl suppressors acting perpendicular to the stack, said compiling tray comprising a back guide or compiling wall connected at one end to a tray base, said base tray having an open end adapted to allow paper to be pushed therein and its lead edge up against said compiling wall, said compiling tray adapted to receive and house a stack of paper, said compiling wall comprising a hook material of hook and loop-type fastener's surface attached thereto, said fastener's surface having a plurality of ribs and grooves set at an angle of from about 30-60 degrees from horizontal and not parallel to a plane of a lead edge of said paper, said bind edge curl suppressors cooperating with said fastener's surface in controlling the effect of down curled and up curled lead edges on said paper as it enters and stacks in said compiling tray and contacts said compiling wall.

11. The structure of claim 10 wherein said compiling wall has an adjusting element that is enabled to alter said angle of said fastener's surface from about 30-60 degrees from parallel to the plane of said paper lead edge.

12. The structure of claim 10 wherein said fastener's surface is fixed on said compiling wall or registration back at an angle of from about 30-60 degrees from parallel to the plane of said lead edge.

13. The structure of claim 10 wherein said fastener's surface is positioned on said registration back at an angle of about 40-50 degrees from parallel to the plane of said lead edge.

14. The structure of claim 10 wherein said fastener is positioned on said compiling wall between at least two bind edge curl suppressors.

15. The structure of claim 10 wherein said fastener surface is enabled to improve paper registration prior to further processing of said paper.

16. The structure of claim 10 wherein said fastener surface is set at an angle of about 45 degrees.

* * * * *